US008919894B1

(12) United States Patent
Pachmayr

(10) Patent No.: US 8,919,894 B1
(45) Date of Patent: Dec. 30, 2014

(54) FLAT PANEL CONSOLE/CABINET ENTERTAINMENT CENTER

(71) Applicant: Michael Barry Pachmayr, Lebanon, MO (US)

(72) Inventor: Michael Barry Pachmayr, Lebanon, MO (US)

( * ) Notice: Subject to any disclaimer, the term of this patent is extended or adjusted under 35 U.S.C. 154(b) by 0 days.

(21) Appl. No.: 13/920,636

(22) Filed: Jun. 18, 2013

(51) Int. Cl.
*A47B 5/00* (2006.01)
*A47B 81/06* (2006.01)

(52) U.S. Cl.
CPC ..... *A47B 81/06* (2013.01)
USPC ..... 312/7.2

(58) Field of Classification Search
CPC ..... A47B 81/06; A47B 21/06; A47B 83/001
USPC ..... 312/7.2, 245, 321.5, 242, 315, 276, 312/281, 282, 313; 211/87.01, 90.01, 211/90.02, 90.04, 94.01; 248/240.1, 240.3, 248/240.4, 250
See application file for complete search history.

(56) References Cited

U.S. PATENT DOCUMENTS

| | | | | | |
|---|---|---|---|---|---|
| 1,320,392 | A * | 11/1919 | Hirschman | 15/265 |
| 1,428,957 | A * | 9/1922 | Hall | 312/315 |
| 4,805,906 | A * | 2/1989 | Wiczer et al. | 273/119 A |
| 5,082,336 | A * | 1/1992 | Munch et al. | 312/292 |
| 5,707,126 | A * | 1/1998 | Neufeld et al. | 312/245 |
| 8,441,782 | B2 * | 5/2013 | Thomas | 361/679.02 |
| 8,662,605 | B2 * | 3/2014 | McRorie et al. | 312/276 |
| 2005/0093404 | A1 * | 5/2005 | Donovan | 312/242 |
| 2007/0126321 | A1 * | 6/2007 | Waugh et al. | 312/245 |
| 2007/0159035 | A1 * | 7/2007 | Mullen | 312/245 |
| 2009/0026900 | A1 * | 1/2009 | DeStefano | 312/242 |
| 2010/0011645 | A1 * | 1/2010 | Milburn-Hall | 40/724 |
| 2011/0235249 | A1 * | 9/2011 | Bustle et al. | 361/679.01 |
| 2012/0145654 | A1 * | 6/2012 | McGowan et al. | 211/26 |

* cited by examiner

*Primary Examiner* — Darnell Jayne
*Assistant Examiner* — Hiwot Tefera

(57) ABSTRACT

A slim profile wall mounted cabinet used in conjunction with a wall hanging flat panel television set having a door or doors opening downward at 90 degrees from the frame of the unit becoming a shelf upon which various electronic devices and other are safely secured and contained within the unit.

1 Claim, 3 Drawing Sheets

FLAT PANEL CONSOLE/CABINET ENTERTAINMENT CENTER

CROSS-REFERENCE TO RELATED APPLICATION

Application No. 61/849,147 Filed on Jan. 22, 2013

BACKGROUND OF THE INVENTION

This invention relates to entertainment centers specifically relating to flat panel televisions and how the electronic devices are stored and maintained in relation to each other. This invention addresses issues which today's manufacturers are over looking or ignoring space and safety.

Int. Cl.: A47B 81/06 (20060101); A47B 81/00 (20060101); F16M 11/10 (20060101); F16M 11/02 (20060101); F16M 11/08 (20060101); F16M 13/00 (20060101); F16M 11/10 (20060101); A47B 097/00
U.S. Cl.: 248/317; 248/340; 248/343; 248/917; 312/245; 312/7.2; 52/39
Field of Search: 248/317, 342, 343, 344, 340, 59, 917, 918, 922, 923, 215, 551, 552, 553, 228, 52/39 312/7.2, 245, 248, 251

BRIEF SUMMARY OF THE INVENTION

The flat panel cabinet console entertainment center is designed as:

- Space-saving alternative to other entertainment centers in use today
- It's slim design efficiently utilizes wall space below the wall mounted television
- It organizes and stores electronic components
- It's latching mechanism can be made to lock as to be safe around small children and pets
- It conceals chords and devices within the cabinet so as not to be an attractive nuisance

DETAILED DESCRIPTION OF THE INVENTION

Figure 1:
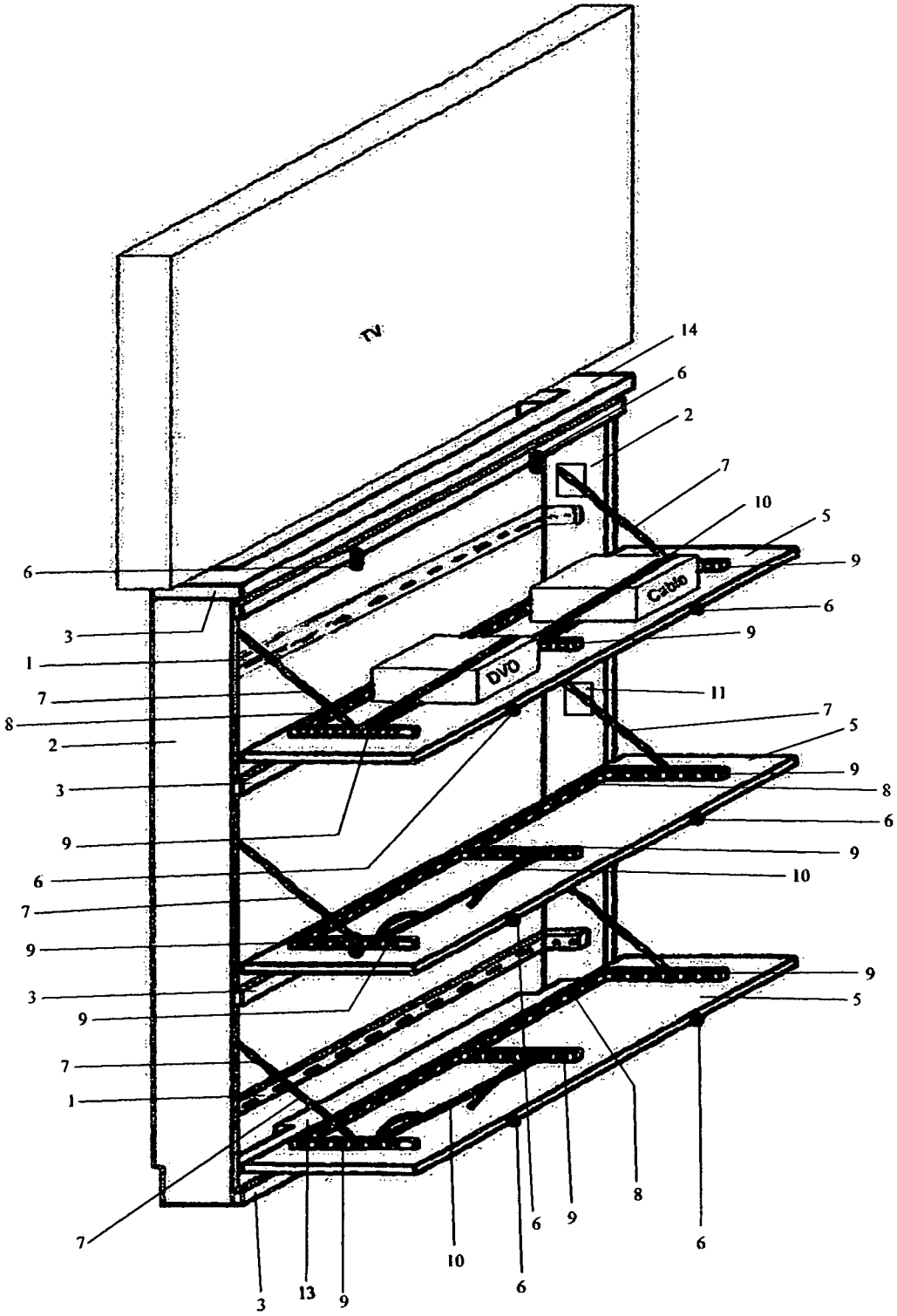
FIG. 1 is an image of the invention used with a flat panel television and electronic devices exhibiting bow the flat panel entertainment center works.

The flat panel console cabinet entertainment center {FIG. 1} is a simple article of construction and can be made with most all materials or composites there of. It is to be used in conjunction with a wall hung flat panel television set.

Concealed within the slim cabinet, made to save space are the various electronic devices most commonly in use today such as, cable units, satellite units, dvd players, computer notebooks and gaming consoles.

Having door panels (5) opening downward 90 degrees from the vertical unit to which they are attached, in turn becoming a shelf upon which those devices are secured enabling the opening and closing of the doors. Those devices now stored and out of sight.

The cabinet easily attaches to the wall by means of two slotted brackets (1) with 90 degree tabs on both ends, These brackets (1) provide the foundation by which the cabinet is assembled. The brackets (1) will run horizontally against the wall and attach to the studs within. Vertical spacing of the brackets (1) is not critical but must allow for clearance of floor moulding and the receptacles found on or within the boarder of the cabinet's interior area.

Attached to each side of the brackets tabs (1) are the side panels (2) which are mounted vertically to the tabs. With the side panels (2) notched at the bottom towards the wall as to avoid standard floor moulding. With the side panels (2) in place it is now time to attach the horizontal door mounting trips(3).

The mounting strips (3) are secured to the front of the side panels edges. Vertical spacing is determined by the size of the door panel (5) being used which will allow an equal gap between the top and bottom of each door panel (5) and mounting strip (3). This gap allows for ventilation and in some cases allows for communicating remotely with a device inside the unit with the door in the closed position or a rfs device can also be easily adapted to the unit.

With the door mounting strips (3) in place and secured, hinges (4) are now evenly spaced and secured to the mounting strips (3) to open outward and down. With hinges (4) in place, it is time to secure door panel (5) to the hinges (4). Please note, door panel (5) may be of different sizes. Their placement is to be determined by it's user. Door panels (5) are placed evenly side to side with gap at top and bottom. Hinges (4) are secured to the door panel's (5) face.

Figure 2:
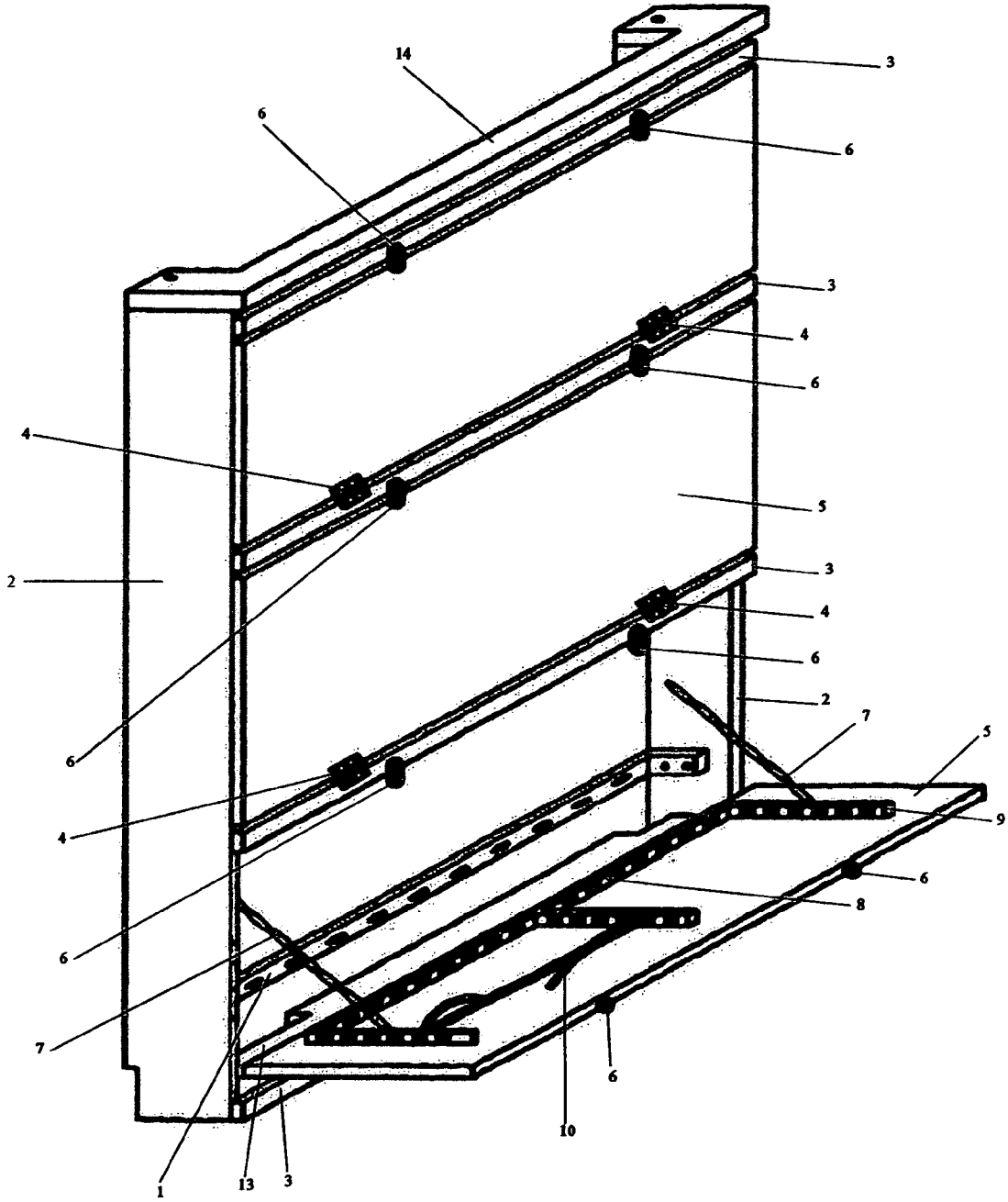
FIG. 2 is a three dimensional image of the front of the flat unit with the visible parts numbered to correspond with parts list.

Also attached to the face of the door panels (5) are the draw catch assemblies (6) evenly spaced at the top of the door panels (5) edge as seen in (FIG. 2) between the hinge (4) and the center to both sides on each door panels (5). The draw catch assemblies (6) are used as an extra precaution to hold door in the upright position and can be made lockable.

Moving to the inside of the cabinet, a set of support chains (7) are secured to the back side of the door and the inside of the side panel pieces (2). This is to insure support for the door panel (5) and to stop the downward travel to 90 degrees.

Also attached to the inside face of the door's rear edge running almost it's entire length is the ledge support strip (8). This ledge support strip (8) provides support to the device or devices when door panels are in motion, opening or mostly in the closing position. The strip (8) is slotted to provide knock-outs for extra room for hookups if needed.

Running perpendicular to the ledge support are the slotted partitions pieces (9) which run parallel with the devices. These partitions (9) are made movable from side to side as needed for secure fit for the device it will hold in place and are attached to the inside face of door.

Threaded through the slotted partitions and secured to them are the velcro fastening strips (10) which will keep the devices secured to the door in the upright or closed position.

Moving further into the cabinet's interior and mounted down the side panel members, are spring loaded retaining clips (11) which are attached to both sides. These retaining clips (11) hold back the chords and cables neatly out of the way that run between the television and the devices contained inside the unit.

Figure 3:
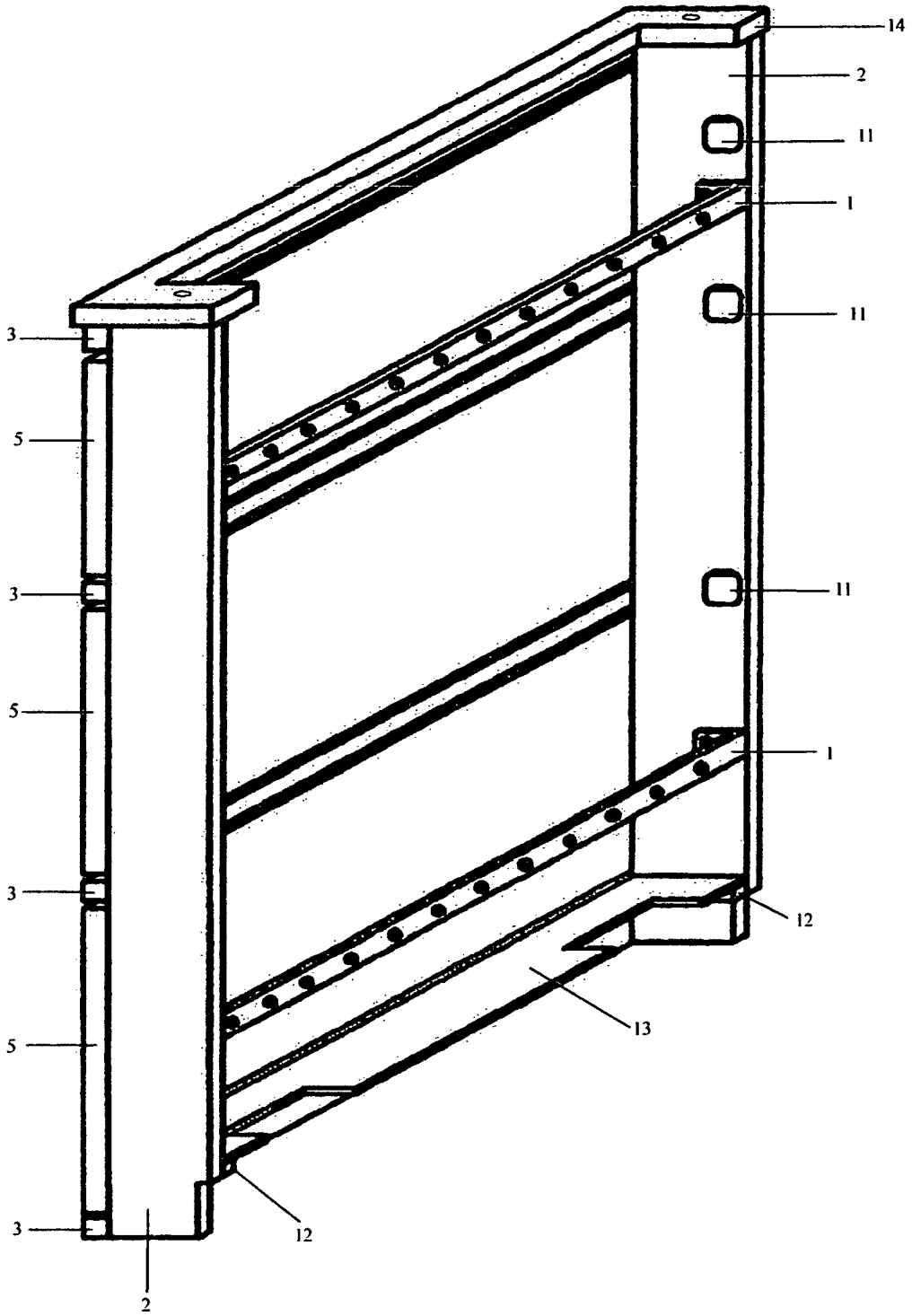
FIG. 3 is a three dimensional image of the back of the flat panel unit with the visible parts numbered to correspond with parts list.

Also attached to the cabinet's interior side panels are shelf support tabs (12). Mounted on opposite sides, these support tabs (12) are movable vertically within the cabinet's interior and give support to an optional shelf (13) when needed. The shelf has a cutout (see FIG. 3) for ventilation and for chords to pass through. The shelf is utilized when devices do not require attachment to the door. It's placement is determined by it's user and as not to interfere with opening and closing of the door or their contents.

Finally the top (14) is attached to the cabinet. Being slightly larger than the unit itselt the top is centered on the cabinet's frame and secured. The top's center is cut out to within inches of the side pieces, leaving enough on each side to bore holes to the inside of the cabinet's interior. Through these holes, chords and cables will pass through to their prespective device or receptacle.

With the flat panel entertainment center constructed it is now ready to be mounted to the wall. Ideal placement of the unit is to have a receptacle within the perimeter of the cabinet's interior. The unit is attached to the wall by construction screws penetrating through the slotted brackets into wall studs. A television is now mounted to the wall above the unit and the two units are allowed to touch. Chords and cables are now routed through the top holes of the cabinet on either side. Down or up through the retaining clips (11) which will hold the cables close to the cabinet's interior sides. If a shelf is used the cables will pass through it's cutout to a receptacle or it's placement in a electronic component.

Attaching electronic components to the panel door (5) is a very simple task. A device is selected and placed on the cabinet's door against the slotted support ledge (8) that runs along the door's rear enterior. The device's lower edge will make contact with this support ledge (8). Knockout slots may be removed to allow for the cables to be placed without interference when a connection is needed, and to allow the device to act level with all legs flat on the door's surface.

With the device in place and butted up against the ledge support strip (8) it is now time to add the slotted partitions (9). The partitions will nm parallel down each side of the device and then secured to the door panel's (5) interior face Please note, that a partition strip (9) running in between two devices may be used for both devices.

Velcro strips (10) will be threaded through the slots and one end secured to the partition on each side ¼ of the way up on the device's upper half. One or more sets of velcro strips (10) may be needed to secure device to door depending on the device's size and weight. If s second set velcro strips (10) is used, Their placement should be ¼ of the way up from the rear of the device. The velcro strips (10) is pulled taut from both sides over the center of the device and secured. With devices installed and secured the flat panel cabinet console entertainment center is now ready for use.

PARTS LISTING (1) Slotted Mourning Bracket
(2) Side Panel
(3) Door Mounting Strip
(4) Hinge
(5) Door Panel
(6) Draw Catch Assembly
(7) Support Chain
(8) Slotted Ledge Support Strip
(9) Slotted Support Partition
(10) Velcro Strip
(11) Spring Retaining Clip
(12) Shelf Support Tab
(13) Shelf
(14) Top

The invention claimed is:

1. An entertainment cabinet adapted to be mounted to a wall, the cabinet comprising:

a top panel, a first side panel, a second side panel, and a bottom panel;

at least one slotted bracket extending between and connected to an inside surface of the first side panel and an inside surface of the second side panel, the at least one slotted bracket adapted to mount the cabinet to the wall;

a plurality of door mounting strips mounted to a front side of the first side panel and second side panel; a plurality of door panels pivotally mounted to the mounting strips; a plurality of door hinges secured to the mounting strips to pivotally move a respective door panel of the plurality of door panels between an open position and a closed position;

a pair of support chains secured to a back side of each door panel and the inside surface of the first side panel and the inside surface of the second side panel, said support chains are adapted to support the respective door panel in the open position at a 90 degree angle with respect to the side panels;

a ledge support strip secured to the back side of each door panel;

a plurality of partition pieces having plurality of holes, the partition pieces are secured perpendicularly to the ledge support strip;

at least one fastening strip threaded through the plurality of holes of the partition pieces to hold a device in the cabinet and prevent the device from falling off when the respective door panel is moved between the open position and closed position;

spring loaded retaining strips attached to the inside surface of the first side panel and second side panel capable of holding cables and cords of the device contained inside the cabinet; the bottom panel having at least one cutout to allow the cords and cables to pass through.

* * * * *